United States Patent [19]

Cosmos et al.

[11] Patent Number: 4,842,554

[45] Date of Patent: Jun. 27, 1989

[54] ONE-PIECE SHIELD FOR A CIRCULAR DIN

[75] Inventors: Pete Cosmos, Mechanicsburg; Benjamin H. Mosser, III, Middletown; William C. Ohl, Harrisburg, all of Pa.

[73] Assignee: AMP Incorporated, Harrisburg, Pa.

[21] Appl. No.: 202,069

[22] Filed: Jun. 3, 1988

[51] Int. Cl.[4] ..... H01R 13/648

[52] U.S. Cl. ..... 439/609; 439/79

[58] Field of Search ..... 439/79, 101, 108, 92, 439/95, 99, 607–610, 425

[56] References Cited

U.S. PATENT DOCUMENTS

| | | | |
|---|---|---|---|
| 2,870,424 | 1/1959 | Franz | 439/79 |
| 4,337,989 | 7/1982 | Asick | 339/143 |
| 4,493,525 | 1/1985 | Hall | 339/143 |
| 4,548,455 | 10/1985 | Ezure | 339/45 |
| 4,611,878 | 9/1986 | Hall | 339/186 |
| 4,623,211 | 11/1986 | Dambach et al. | 339/143 |
| 4,634,208 | 1/1987 | Hall | 339/143 |
| 4,637,669 | 1/1987 | Tajima | 339/14 |
| 4,639,066 | 1/1987 | Shimamiya et al. | 439/79 |
| 4,679,879 | 7/1987 | Triner et al. | 439/425 |
| 4,695,105 | 9/1987 | Ney | 439/95 |

OTHER PUBLICATIONS

AMP Catalog 83-700, Rev. 10-86.

*Primary Examiner*—Neil Abrams
*Assistant Examiner*—Khiem Nguyen
*Attorney, Agent, or Firm*—David L. Smith

[57] ABSTRACT

A one-piece metal shield (12) for a surface mounted connector (10) having a substantially rectangular body (14) from which a plug portion (16) projects forwardly, is in the form of a rectangular box-like structure having a top wall (24) side walls (26) and a front wall (28). The front wall (28) has a circular opening (30) from the periphery of which spring fingers (34) project inwardly of the shield (12) for engaging the shielding (19) of a shielded electrical socket inserted through the opening (30) to mate with the plug portion (16). The shield (12) is secured to the body (14) by means of flanges (48 and 50) thereon which engage with a snap action in grooves (82, 86) in the body (14). At least the side walls (26) have mounting legs (54) for securing the shield (12) and thus the body (14) to a substrate (S).

31 Claims, 5 Drawing Sheets

A
12
14
10
24
26
44
46
48
50
52
54'
54''
56
17
18
19
22
62
65
67
68
70
72
74
76
78
80
81
82
84
86
88
89
90
93
95
96
98
100
102
104
106
108
110
112
114
AP
AP1
H
S

ONE-PIECE SHIELD FOR A CIRCULAR DIN

FIELD OF THE INVENTION

This invention relates to a metal shield for a surface mounted electrical connector having a substantially rectangular cross-section body in which a circular cross-section plug portion projects forwardly for mating with a circular cross-section externally shielded electrical socket.

BACKGROUND OF THE INVENTION

There is disclosed in U.S. Pat. No. 4,637,669 a shielding means for such a surface mounted connector, which is generally known as a "Miniature Circular DIN Type Connector," the shielding means comprising a first shield which encloses the top and sides of the body of the surface mounted connector, and a further, internal shield, which is of circular cross-section and which has a flared mouth for receiving said externally shielded socket. Also, there is disclosed in U.S. Pat. No. 4,493,525 a shield for a surface mounted connector of the type under discussion, the shield comprising a front plate which is adapted to be secured to the body of the surface mounted connector and which has a central circular socket access opening from the periphery of which project a series of spring fingers for making electrical contact with the shielding of said socket. Additional shielding would be required if the surface mount connector needed to be further shielded.

SUMMARY OF THE INVENTION

The present invention is intended to provide a one-piece shield for a miniature circular DIN connector or the like, which can readily be assembled thereto and which is capable for shielding the connector on at least four sides, as well as serving to make electrical contact with the shielding of the externally shielded socket when it is mated with the surface mounted connector.

According to the present invention, the shield comprises a rectangular, box-like structure comprising a top wall, a pair of side walls each adjacent to the top wall and depending from opposite lateral edges thereof and a front wall adjacent to the top wall and the side walls. The front wall has a circular through opening therein for receiving the externally shielded socket, a series of resilient cantilever fingers which are spaced from each other around the circular opening, projecting from its edge inwardly of the shield, for engaging the external shielding of the socket. The shield has means, for example, flanges, for engaging in grooves in the body of the surface mounted connector with a snap action, for anchoring the shield thereto. The shield also has means, for example, mounting legs projecting from the side walls and from the front wall, for reception in apertures in a substrate upon which the surface mount connector is to be mounted.

The resilient cantilever fingers preferably have adjacent to, or at, their free ends, a radially inward offset or embossments projecting from the fingers in the radially inwardly direction of the circular opening in the front wall, for limiting deflection, and thus over-stressing, of the fingers by the socket, when its shielding is engaged thereby. The means for anchoring the shield to the body may comprise a pair of tabs each depending from a respective lateral edge of the top wall, at a position remote from the front wall and each terminating in a flange for engaging in said grooves in the said body of the surface mounted connector. Further flanges may be bent inwardly from the side walls so as to lie in parallel contiguous relationship with the flanges first mentioned, for engagement therewith, in said grooves, more securely to anchor the shield to the said body.

In addition to, or instead of, said flanges, the anchoring means may comprise a pair of resilient detents each projecting obliquely from one of the side walls of the shield in the general direction of the other side wall, for snap engagement in a notch in a lateral wall of said body.

The shield may be secured to the substrate by means of mounting feet projecting from the side walls of the shield and being formed as claws bowed outwardly of the shield, for resilient engagement with the edges of the openings in the substrate.

Each mounting foot may, however, be bifurcated so as to comprise two portions, each portion terminating in a barb for engaging the underside of the substrate when the surface mounted connector with the shield thereon has been mounted on the substrate.

The invention also concerns the shield and the surface mounted connector when in the combination.

The grooves for receiving the said flanges, which are preferably formed in opposite side walls of the body may extend from the forward end to the rear end thereof, being deeper proximate to said rear end so that the flanges engage in deepened portions of the grooves with a snap action as the shield is fully assembled to the surface mounted connector.

DETAILED DESCRIPTION OF THE INVENTION

For a better understanding of the invention, reference will now be made by way of example to the accompanying drawings in which.

Figure 1:
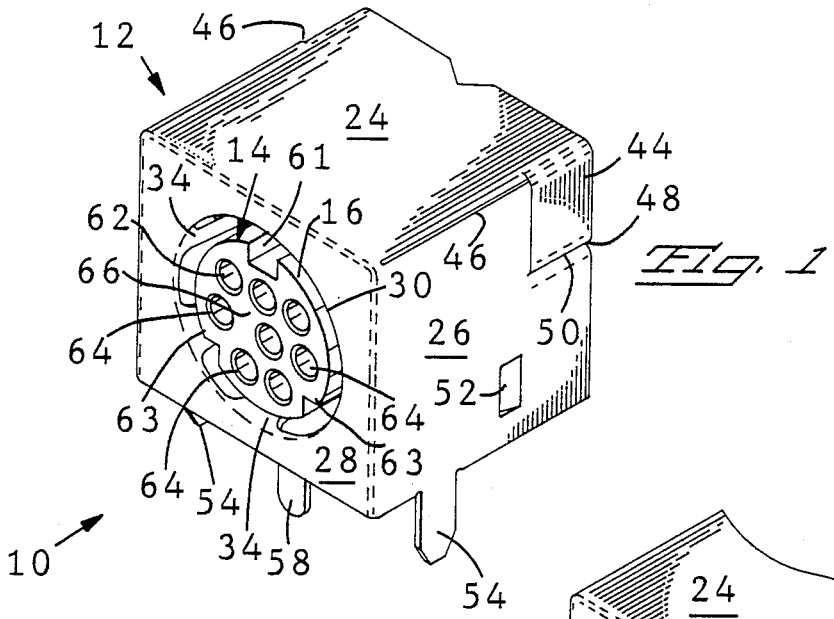
FIG. 1 is a fragmentary isometric view of a shielded, surface mounted eight position electrical connector.
Figures 1A, 2, 3:
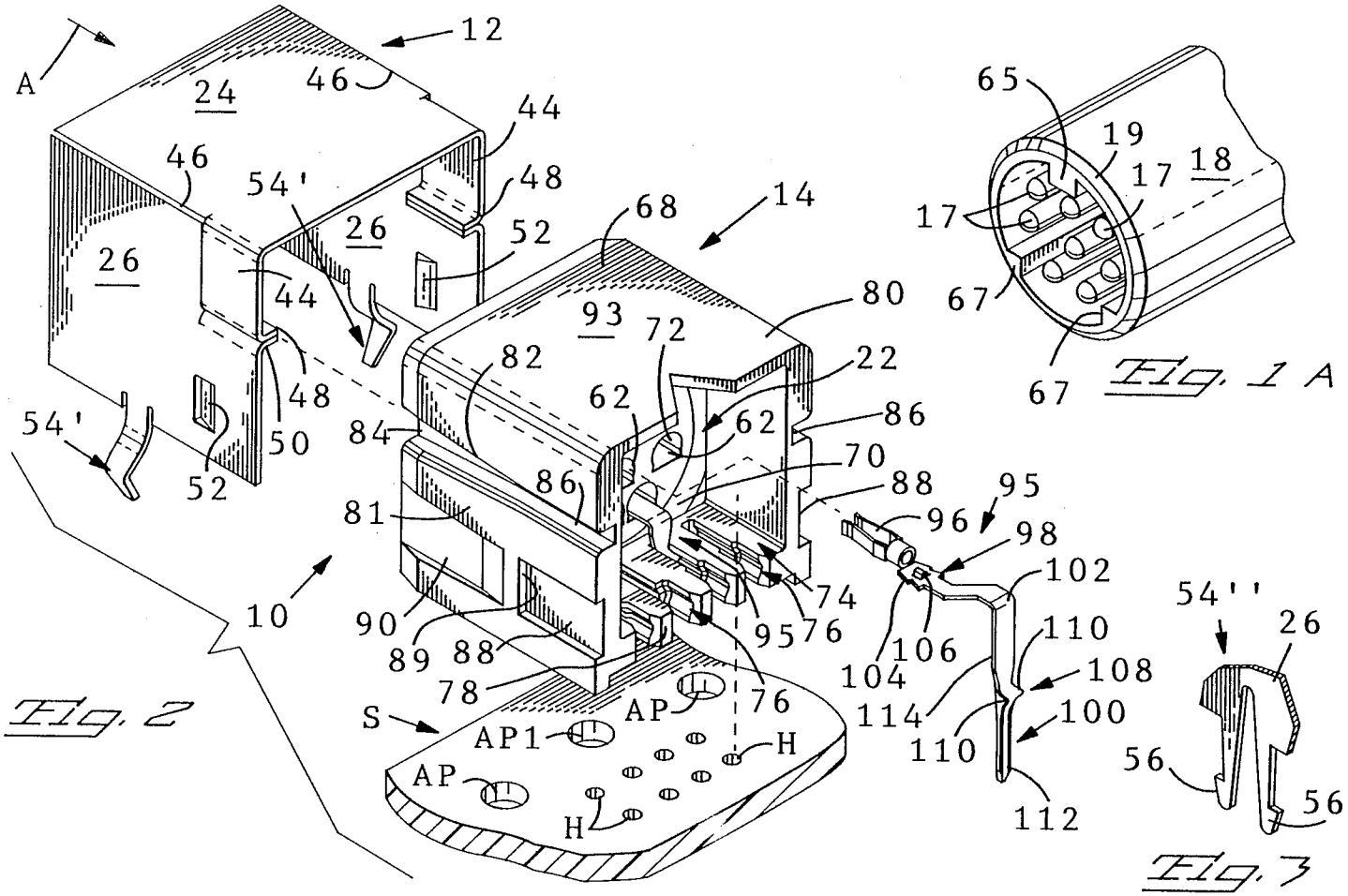
FIG. 1A is a fragmentary isometric view of a shielded electrical socket.
FIG. 2 is an isometric, partly diagrammatic exploded view of a modified version of the connector.
FIG. 3 is a fragmentary isometric view illustrating a modification of the mounting feet of the connector of FIG. 2.

As shown in FIGS. 1 and 2, a shielded electrical connector for mounting on a substrate, for example a printed circuit board, comprises a one piece metal shield 12 and a substantially rectangular cross-section, one piece, molded, insulating connector body 14. There projects from the connector body 14, forwardly, a circular cross-section plug portion 16 for mating with a circular cross-section externally shielded electrical socket 18 (FIG. 1A) having a metal shield 19, and into which project electrical pins 17.

Figure 11:
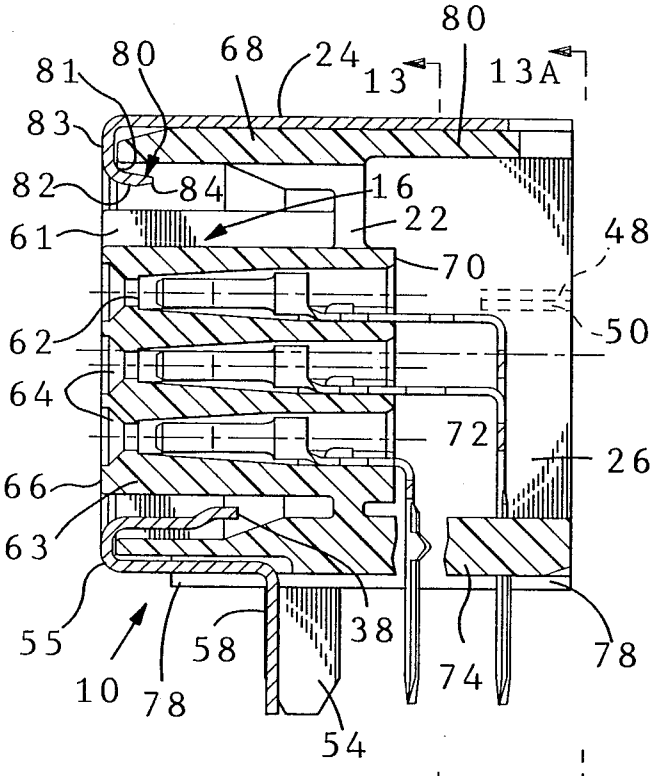
FIG. 11 is an axial actual sectional view of the shielded connector of FIG. 1.

As best see in FIG. 11, the body 14 has a central portion 22 from which the plug portion 16 projects.

Figure 4:
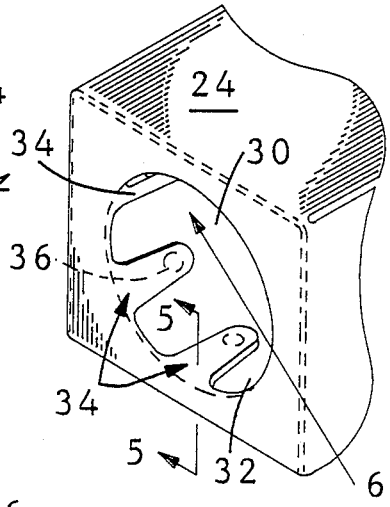
FIG. 4 is a fragmentary isometric view of a part of the metal shield of the connector of FIG. 1.
Figure 6:
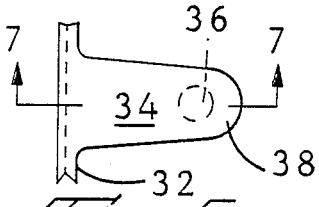
FIG. 6 is a fragmentary view taken in the direction of the arrow 6 in FIG. 4.
Figure 7:
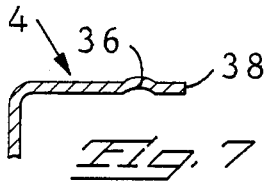
FIG. 7 is a view taken on the lines 7–7 of FIG. 6.

The shield 12 comprises a top wall 24, a pair of side walls 26, each adjacent to the top wall 24 and depending from opposite lateral edges thereof. A front wall 28 adjacent to the top wall 24 and the side walls 26, is formed integrally therewith and has a circular, through opening 30 therein, for receiving the socket 18. The opening 30 has a circular edge 32 from which project a series of resilient cantilever fingers 34 on the shield 12, rearwardly thereof, for engaging the external shielding 19 of the socket 18, the fingers 34 being constantly spaced from one another about the edge 32. Fingers 34 are formed from the portion of surface 28 that otherwise would enclose opening 30. As shown in FIGS. 4, 6 and 7, each finger 34 has formed therein an embossment 36 proximate to, but spaced back from, its free end 38 and projecting in the radially inward direction of the opening 30 in order to limit free deflection of the fingers 34 by the socket portion 18 as it is being mated with the plug portion 16, so that the shield 19 of the latter engages the embossments 36 and does not overstress the fingers 34.

Figure 8:
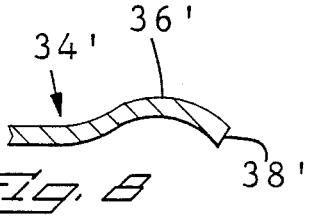
FIGS. 8 and 9 are a longitudinal sectional view and an isometric view, respectively, illustrating a modification of the part shown in FIGS. 6 and 7.
Figure 9:
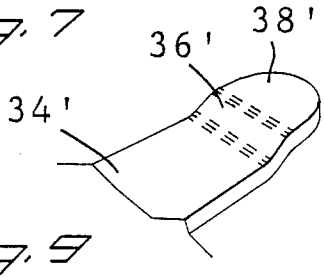

According to the modification shown in FIGS. 8 and 9, in which the finger is referenced 34' and the embossment, 36', the embossment 36' is formed at the end of the finger 34'.

Figure 5:
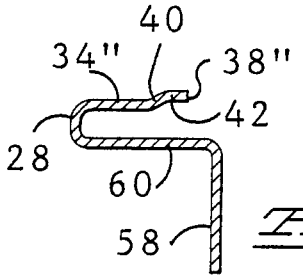
FIG. 5 is a view taken of the lines 5–5 of FIG. 4.

According to the modification shown in FIG. 5, the finger, which is referenced 34" is formed with a joggle 40 spaced back from its free end 38" to provide a raised shoulder 42 for engaging the shield 19.

Figure 15:
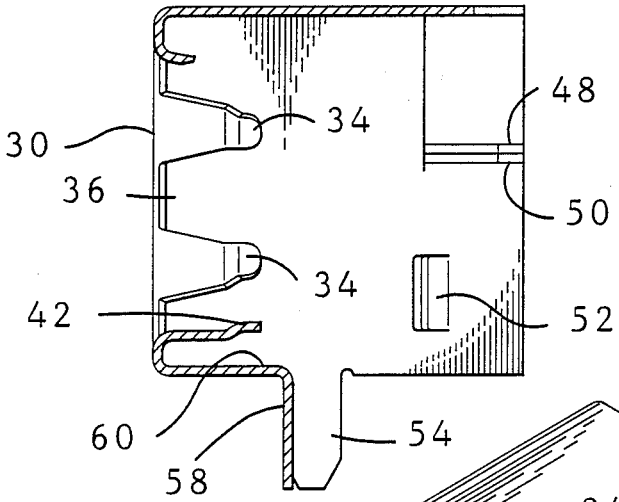
FIG. 15 is an axial sectional view of the shield of the connector of FIG. 1.
Figures 13, 13A:
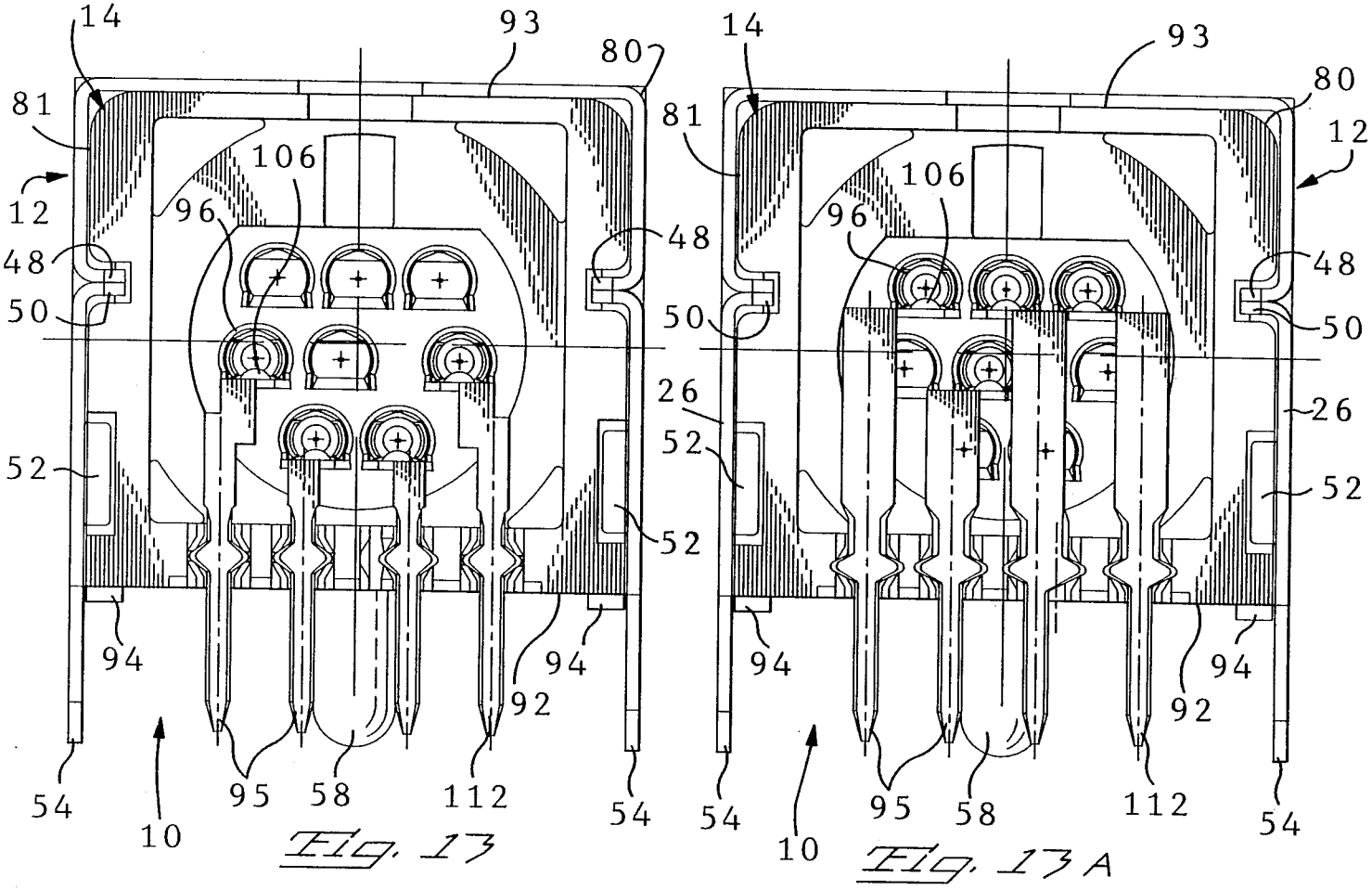
FIG. 13 is a fragmentary rear view of the connector of FIG. 1 having the terminals in the forward substrate row of holes secured therein.
FIG. 13A is a rear view of the connector of FIG. 2 having the terminals in the rearward substrate row secured therein.

There depend from opposite lateral edges 46 of the top wall 24 at its rear end, that is to say at its end remote from the front wall 28, tabs 44, each tab 44 terminating in a flange 48, the flanges 48 projecting towards each other, that is to say inwardly of the shield 12. Just below (as seen in FIGS. 2 and 13, as well as in FIG. 15), each flange 48 the respective side wall 26 is formed with a further inturned flange 50, extending parallel to, and being contiguous with, the flange 48 thereabove. Below the flange 50, each side wall 26 has struck out therefrom, a detent 52 in the form of a resilient tongue projecting obliquely interiorly of the shield 12 proximate to its rear end.

Figure 10:
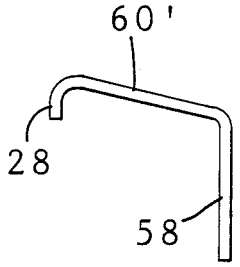
FIG. 10 is a similar view to that of FIG. 5 but illustrating a modification of the parts shown therein.
Figure 14:
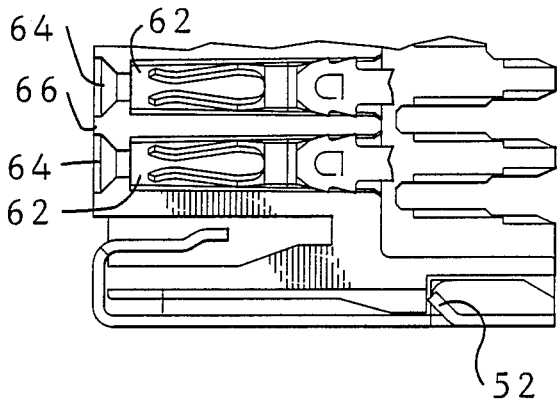
FIG. 14 is a fragmentary horizontal sectional view of the connector of FIG. 1.

The shield 12 is further provided with means for securing it to the substrate S, in the form of mounting feet 54 (FIGS. 1, 11, 13, and 15), 54' (FIG. 2), or 54" (FIG. 3) depending from the respective side walls 26. The mounting feet 54 are in the form of a simple tab, the mounting feet 54' being in the form of claws which are bowed in opposite directions, outwardly of the shield 12, the mounting feet 54" being bifurcated and thus comprising two portions, each portion terminating in a barb 56 and said portions being resiliently deflectable towards each other. The front wall 28 is provided with a further mounting foot 58 depending from a rearward extension 60 of the front wall 28 extending parallel to the top wall 24 or, as shown in FIG. 10, an extension 60' of the front wall 28 extending obliquely downwardly therefrom. Said extensions may be said to constitute rudimentary bottom walls of the shield 12.

The plug portion 16 is formed with terminal receiving, parallel cavities 62 extending therethrough, axially thereof and each having a pin receiving flared mouth 64 opening into a mating face 66 body of the plug portion 16. The central portion 22 has projecting forwardly therefrom a hood 68 surrounding the plug portion 16 in spaced relationship thereto, to allow the socket 18 to be mated with the plug portion 16. The portion 22 of the housing 14 has a terminal receiving face 70 opposite to the mating face 66, each cavity 62 extending through the portion 22 and having a terminal receiving mouth 72 opening into the face 70.

The plug portion 16 has axial keyways 61 and 63 for the reception of complementary keys 65 and 67 in the socket 18.

A terminal leg spacer plate 74 extending along the lower edge of the face 70, in a direction away from the plug portion 16 is formed with a plurality of elongate, in the axial direction of the cavities 62, terminal leg receiving spacer notches 76 each extending normally of the face 70 and opening into the rear edge 78 of the spacer plate 74, remote from the face 70, each notch 76 being shaped for the retention two terminal legs therein, to correspond to the two rows of terminal leg receiving apertures in the footprint of the connector.

Notches 76 in spacer plate 74 define sidewalls 75. V-shaped grooves 77 in sidewalls 75 receive lugs 100, which are preferably pointed as shown in FIGS. 13 or 13A, skive side walls 75 upon insertion and prevent withdrawal of legs 100 from notches 76. Lugs 110 not only secure leg 100 in notch 76 but also prevent leg 100 from moving normal to spacer plate 74.

Figure 12:
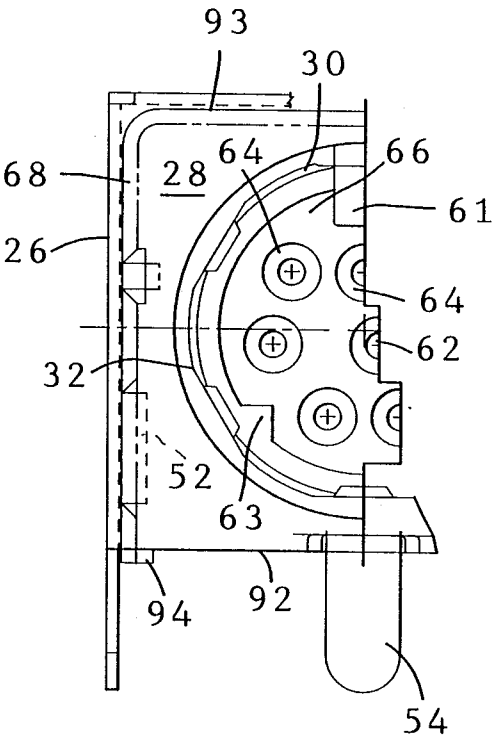
FIG. 12 is a fragmentary front view of the shielded connector of FIG. 1.

A protective skirt 80 projects from the face 70 of the portion 22, rearwardly from the periphery thereof and adjoins each end of the spacer plate 74. The hood 68, the portion 22, and the skirt 80 are formed on each side wall 81 of the body 14 with a common external groove 82 opening into the forward edge of the hood 68 and the rear edge of the skirt 80, each groove 82 having a flared flange receiving mouth 84 opening into the forward edge of the skirt 68 and a deepened portion 86 opening into the rear edge 78 of the skirt 80. Each side of the skirt 80 is formed with a recess 88 opening into the rear edge of the skirt 80 below the groove portion 86 defining shield retaining shoulder 89. The hood 68 is formed on either side thereof with an external relief recess 90 opening into the forward edge of hood 68. The body 14 has a bottom mounting face 92 opposite to its top wall 93, provided with stand offs 94 as shown in FIGS. 11 to 13, the face 92 being parallel to the plate 74.

Electrical terminals 95 each for reception in a respective cavity 62 each comprise a forward, mating part in the form of a receptacle 96, an intermediate insertion and retention part 98 connected to the rear end of receptacle 96 and a terminal leg 100 connected to the rear end of the part 98 by way of an arm 102, the leg 100 extending at right angles to the remainder of the terminal 95. The receptacle 96 is formed in accordance with U.S. Pat. No. 4,776,651, and the insertion and retention part 98 which comprises a laterally barbed retention plate 104 and an insertion hump 106 is formed in accordance with U.S. Pat. No. 4,775,336, both of which patents are incorporated herein by reference. The leg 100 is provided with retaining means in the form of a substantially U-shaped retaining member 108 presenting retention lugs 110, shown in outline in FIG. 2. Each leg 100 has an insertion lance 112 below the member 108 and a leg portion 114 between the member 108 and the part 98. A rear view of the terminals 95 in body 14 is shown in FIGS. 13 and 13A.

In order to assemble the shield 12 to the connector body 14, the terminals 95 having been inserted into the cavities 62 with the forward ends of the receptacles 96 thereof proximate to the mouths 62 and their legs 100 retained in the notches 76 by means of the retaining members 108, the shield 12 is slid onto the connector body 14 in the direction of the arrow A in FIG. 2. During this operation, the flanges 48 and 50 enter respective grooves 82, guided by their flared mouths 84, and finally snap into the deepened portions 86 of the grooves 84, the detents 52 pass along the recess 90 and likewise snap into the recesses 88, an edge thereof engaging retaining shoulder 89. The shield is thereby firmly secured to the body 14.

The lances 112 which protrude below the mounting face 92 are then inserted into respective holes H in the substrate S, the mounting feet 54, 54' or 54'', as the case may be, entering respective apertures AP in the substrate S, and the mounting foot 58 entering an aperture API in the substrate S. The mounting feet 54 and 58 simply wedge in their respective apertures. The mounting feet 54', however, are resiliently depressed inwardly of the shield 12 by the edges of the apertures AP, inwardly bowed root portions of the feet 54' being accommodated by the recesses 90, and finally reside, to engage against the lower surface of the substrate S. The two portions of each mounting foot 54'' are compressed towards each other by the edge of the respective aperture AP and finally resile, so that the barbs 56 engage against the lower surface of the substrate S.

Preferably the lugs 110 of each retaining member 108 have sharp edged skiving wings 121 projecting therefrom for biting into the walls of the respective notch 76. Lugs 110 are preferably pointed as shown in FIG. 13 or 13A, with lugs 110 complementary to and received in grooves 77 in sidewalls 75.

Figure 16:
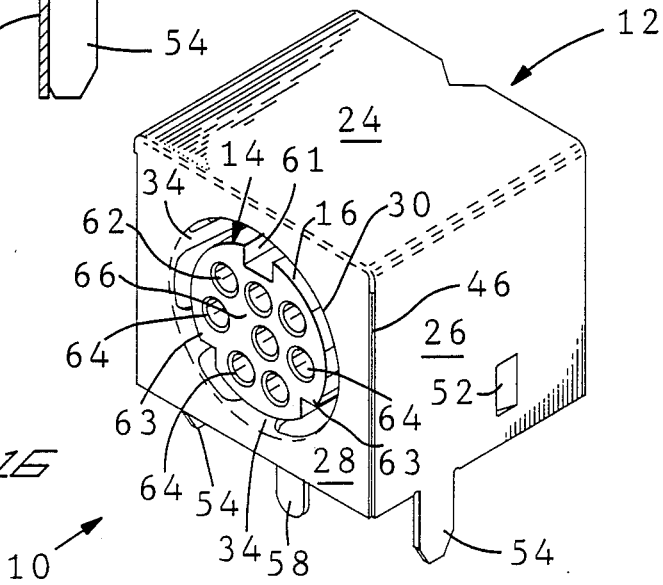
FIG. 16 is an isometric view of a shielded, surface mounted eight position electrical connector, having an alternate embodiment shield.

FIG. 16 shows an isometric view of a shielded, surface mounted eight position electrical connector similar to the shielded surface mounted electrical connector shown in FIG. 1. The connector shown in FIG. 16 has an alternate embodiment shield wherein the side walls are formed integral with the top wall.

We claim:

1. A one piece metal shield for a surface mounted electrical connector having a substantially rectangular cross-section body in which projects forward a circular cross-section plug portion for mating with a circular cross-section, externally shielded electrical socket, the shield comprising;

a top wall for enclosing a top wall of said body;

a pair of shield side walls each adjacent to the shield top wall and depending from opposite lateral edges thereof, for enclosing opposite side walls of said body;

a shield front wall adjacent to the shield top wall and to the shield side walls and having a circular, through opening therein for receiving said socket, said opening having a circular edge, a series of resilient, cantilever fingers spaced from each other around said opening and projecting from said edge into said shield for resiliently engaging the external shielding of said socket;

means on said shield projecting inwardly thereof for anchoring said shield about said body; and means depending from said shield for securing said shield to a substrate, wherein said anchoring means comprises a pair of tabs each depending from a respective lateral edge of said shield top wall at a position remote from said shield front wall and each terminating in an anchoring flange, the flanges projecting towards each other, each for reception in a groove formed in a respective side wall of said body and extending longitudinally of said plug portion and wherein further flanges project from said shield side walls, each in contiguous, parallel relationship with one of said anchoring flanges for reception in said groove therewith.

2. A shield as claimed in claim 1, wherein said fingers have adjacent to their free ends embossments projecting therefrom in the radially inwardly direction of said circular opening, for limiting deflection of said fingers by said socket.

3. A shield as claimed in claim 1, wherein the anchoring means further comprises a pair of resilient detents each projecting obliquely from one of the shield side walls in the general direction of the other shield side wall, for snap engagement in a notch in lateral wall of said body.

4. A shield as claimed in claim 1, wherein said securing means comprises mounting feet each protruding from an edge of one of the shield side walls, remote from the shield top wall.

5. A shield as claimed in claim 4, wherein a further mounting foot depends from a rearward extension of said shield front wall, remote from said shield top wall.

6. A shield as claimed in claim 4, wherein each mounting foot is formed as a claw, bowed outwardly of said shield.

7. A shield as claimed in claim 4, wherein each mounting foot is bifurcated and thus comprises two portions, each portion terminating in a barb.

8. A shield as claimed in claim 1, wherein said securing means comprises a mounting foot extending from a rudimentary bottom wall of said shield, which projects from said shield front wall normally thereof.

9. A substantially rectangular cross-section electrical connector body in which projects forwardly a circular cross-section plug portion for mating with a circular cross-section externally shielded electrical socket, in combination with a one piece metal shield slidably receiving said body, said shield comprising;

a substantially rectangular box-like structure having a top wall, and two opposite side walls and a front wall, all depending from said top wall, said plug portion terminating rearwardly of said front wall;

a plurality of cantilever spring fingers projecting from, and spaced from each other about the periphery of a central, circular through opening in said front wall, and extending rearwardly between said side walls and surrounding said plug portion for resiliently engaging the shielding of said socket when it has been mated with said plug portion;

means on said shield for securing said body to a substrate with said plug portion extending parallel thereto; and means on said shield in snap fit engagement with cooperating means on said rectangular cross-section portion to anchor said shield to said body, wherein said snap fit engagement means comprises anchoring flanges projecting inwardly of said side walls, said cooperating means comprising rearwardly extending grooves in said body, said grooves having forward flange receiving flared mouths, deepening abruptly at positions remote from said mouths.

10. The combination claimed in claim 9, wherein said fingers have embossments bowed towards said plug portion for resiliently engaging the shielding of said socket.

11. The combination claimed in claim 9, wherein said securing means comprise bowed extensions of said side walls, which project there below for resilient retention in respective apertures in said substrate.

12. The combination claimed in claim 11, wherein side walls of said body are recessed to accommodate flexure of said bowed extensions towards each other.

13. The combination claimed in claim 9, wherein said securing means comprise pairs of juxtaposed arms on said side walls projecting therebelow, each arm terminating in a barb, the barbs of each pair of arms being oppositely directed, said arms being resiliently flexible toward each other.

14. The combination claimed in claim 9, wherein said snap engagement means comprise resilient tongues extending inwardly from said side walls for snap engagement in recesses in said body.

15. The combination claimed in claim 9, wherein said securing means comprise mounting feet depending from a rudimentary bottom wall of said shield, extending from said front wall.

16. A surface mounted, shielded electrical connector comprising in combination;

a substantially rectangular cross-section connector body having a forward end and a rear end and in which projects forwardly a circular cross-section plug portion for mating with a circular cross-section externally shielded electrical socket, said body being formed with opposed external grooves each opening into said forward end and extending towards said rear end and each having therein proximate to said rear end a shield retaining means; and a substantially rectangular, box-like, one-piece metal shield for slidably receiving said body in the longitudinal direction of said plug portion with the forward end of said body leading, said shield having a top wall dimensioned fully to enclose a top wall of said body, a pair of shield side walls each adjacent to said top wall and depending from opposite lateral edges thereof and being dimensioned fully to enclose opposite side walls of said body, a shield front wall adjacent to said shield top wall and having a circular, through opening therein for receiving said socket, a series of resilient cantilever fingers spaced from each other around said opening and projecting from a circular edge of said opening into said shield for resiliently engaging the external shielding of said socket, and internally projecting shield anchoring means remote from said front wall for slidable reception in said grooves and snap engagement with said shield retaining means therein to anchor said shield to said body proximate to said rear end thereof.

17. The combination claimed in claim 16, wherein said snap fitting anchoring means comprises anchoring flanges projecting inwardly of said side walls, said cooperating means comprising rearwardly extending grooves in said body, said grooves having forward flange receiving flared mouths, deepening abruptly at positions remote from said mouths.

18. A one piece metal shield for an electrical connector having a substantially rectangular cross-section body having an annular recess within which projects forward a circular cross-section plug portion for mating with a circular cross-section, externally shielded electrical socket, the shield comprising:

a top wall for enclosing substantially the entirety of a top wall of said body;

a pair of shield side walls, each adjacent to the shield top wall, for enclosing substantially the entirety of opposite side walls of said body; and a shield front wall adjacent to the shield top wall and the shield side walls, said shield front wall having a substantially circular through opening therein for receiving said socket, whereby the shield is adapted to provide shielding over substantially the entire connector.

19. A one piece metal shield as recited in claim 18 wherein said opening defines an edge, further comprising a plurality of resilient cantilever fingers spaced from each other around said opening and projecting from said edge into said shield for resiliently engaging the external shielding of said socket when received therein.

20. A one piece metal shield as recited in claim 18, further comprising means on said shield for securing said shield to said body.

21. A one piece metal shield as recited in claim 18, wherein said side walls depend from opposite lateral edges of said top wall.

22. A one piece metal shield as recited in claim 18, wherein said side walls depend from opposite lateral edges of said front wall.

23. A one piece metal shield as recited in claim 18, further comprising means depending from said shield for securing said shield to a substrate.

24. A one piece metal shield as recited in claim 23, wherein said securing means comprises a mounting foot extending from a rudimentary bottom wall of said shield, which projects from said shield front wall normally thereof.

25. A shielded electrical connector, comprising:

an insulative, substantially rectangular cross-section housing having an annular recess within which projects forward a circular cross-section plug portion for mating with a circular cross-section, externally shielded electrical socket, said housing having a top wall, side walls, and a front wall;

a one piece metal shield, said shield having a top wall for enclosing substantially the entirety of a top wall of said housing;

a pair of shield side walls each adjacent to the shield top wall, for enclosing substantially the entirety of side walls of said housing; and a shield front wall adjacent to the shield top wall and the shield side walls, said shield front wall having a substantially circular through opening therein for receiving said socket, whereby shielding is provided over substantially the entire connector.

26. A shielded electrical connector as recited in claim 25, wherein said opening defines an edge, further comprising a plurality of resilient, cantilever fingers spaced from each other around said opening and projecting from said edge into said shield for resiliently engaging the external shielding of said socket when received therein.

27. A shielded electrical connector as recited in claim 25, further comprising means on said shield for securing said shield to said housing.

28. A shielded electrical connector as recited in claim 25, wherein said side walls depend for opposite lateral edges of said top wall.

29. A shielded electrical connector as recited in claim 25, wherein said side walls depend from opposite lateral edges of said front wall.

30. A shielded electrical connector as recited in claim 25, further comprising means depending from said shield for securing said shield to a substrate.

31. A shielded electrical connector as recited in claim 30, wherein said securing means comprises a mounting foot extending from a rudimentary bottom wall of said shield, which projects from said shield front wall normally thereof.

* * * * *